US010480472B2

(12) United States Patent
Ryon et al.

(10) Patent No.: US 10,480,472 B2
(45) **Date of Patent: *Nov. 19, 2019**

(54) VARIABLE ANGLE MULTI-POINT INJECTION

(71) Applicant: Delavan Inc., West Des Moines, IA (US)

(72) Inventors: Jason A. Ryon, Carlisle, IA (US); Philip E. O. Buelow, West Des Moines, IA (US); John Earl Short, Norwalk, IA (US)

(73) Assignee: Delavan Inc., West Des Moines, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/677,617

(22) Filed: Aug. 15, 2017

(65) Prior Publication Data

US 2018/0010563 A1 Jan. 11, 2018

Related U.S. Application Data

(62) Division of application No. 13/767,402, filed on Feb. 14, 2013, now Pat. No. 9,745,936.
(Continued)

(51) Int. Cl.

| | |
|---|---|
| ***F23R 3/28*** | (2006.01) |
| ***F23D 11/38*** | (2006.01) |
| ***F02M 61/16*** | (2006.01) |

(52) U.S. Cl.
CPC ..... *F02M 61/162* (2013.01); *F23D 11/383* (2013.01); *F23R 3/28* (2013.01); *F23D 2213/00* (2013.01); *F23D 2900/11101* (2013.01)

(58) Field of Classification Search
CPC ..... F02M 61/162; F23D 11/383; F23R 3/28
See application file for complete search history.

(56) References Cited

U.S. PATENT DOCUMENTS

| | | | |
|---|---|---|---|
| 2,607,193 | A | 8/1952 | Berggren et al. |
| 2,628,867 | A | 2/1953 | Purchase, Jr. |

(Continued)

FOREIGN PATENT DOCUMENTS

| | | | |
|---|---|---|---|
| CA | 2335349 | A1 | 1/2000 |
| EP | 121877 | A2 | 10/1984 |

(Continued)

OTHER PUBLICATIONS

Extended European Search Report, issued in corresponding European Patent Application No. 13155488.3, dated Apr. 18, 2017.

*Primary Examiner* — Viet Le
*Assistant Examiner* — Christopher R Dandridge
(74) *Attorney, Agent, or Firm* — Locke Lord LLP; Scott D. Wofsy; Joshua L. Jones

(57) ABSTRACT

A nozzle for injecting liquid includes a nozzle body defining a flow channel and a swirl ante-chamber in fluid communication with the flow channel. An injection point orifice is defined in the swirl ante-chamber. The flow channel feeds into the swirl ante-chamber to impart a tangential flow component on fluids entering the swirl ante-chamber to generate swirl on a spray issuing from the injection point orifice. A second flow channel can be included in fluid communication with the swirl ante-chamber. The second flow channel feeds into the swirl ante-chamber in cooperation with or in opposition to the first flow channel. The first flow channel, second flow channel, and swirl ante-chamber are configured and adapted to adjust spray angle of a spray issuing from the injection point orifice by varying flow apportionment among the first and second flow channels.

7 Claims, 16 Drawing Sheets

Related U.S. Application Data

(60) Provisional application No. 61/599,659, filed on Feb. 16, 2012.

(56) References Cited

U.S. PATENT DOCUMENTS

| | | | | |
|---|---|---|---|---|
| 3,680,793 | A | 8/1972 | Tate et al. | |
| 4,598,553 | A | 7/1986 | Saito et al. | |
| 5,409,169 | A | 4/1995 | Saikalis et al. | |
| 5,713,206 | A | 2/1998 | McWhirter et al. | |
| 5,934,555 | A | 8/1999 | Dobbeling et al. | |
| 6,092,363 | A | 7/2000 | Ryan | |
| 6,363,726 | B1 | 4/2002 | Durbin et al. | |
| 6,533,954 | B2 | 3/2003 | Mansour et al. | |
| 6,755,024 | B1 | 6/2004 | Mao et al. | |
| 6,854,670 | B2 | 2/2005 | Sumisha et al. | |
| 7,520,134 | B2 | 4/2009 | Durbin et al. | |
| 7,926,178 | B2 | 4/2011 | Thomson et al. | |
| 8,313,046 | B2 * | 11/2012 | Short | F23D 11/383 239/463 |
| 9,745,936 | B2 * | 8/2017 | Ryon | F23R 3/28 |
| 2006/0218925 | A1 | 10/2006 | Prociw et al. | |
| 2008/0203193 | A1 * | 8/2008 | Kakade | A61M 15/009 239/468 |
| 2010/0051726 | A1 | 3/2010 | Houtman et al. | |
| 2011/0031333 | A1 | 2/2011 | Short | |
| 2012/0234944 | A1 * | 9/2012 | Overman | F23D 11/106 239/553.5 |
| 2012/0292408 | A1 | 11/2012 | Short | |
| 2014/0090394 | A1 * | 4/2014 | Low | F23R 3/28 60/776 |

FOREIGN PATENT DOCUMENTS

| | | | |
|---|---|---|---|
| EP | 1193450 | A1 | 4/2002 |
| EP | 1344978 | A1 | 9/2003 |
| EP | 1793165 | A2 | 6/2007 |

* cited by examiner

Fig. 20
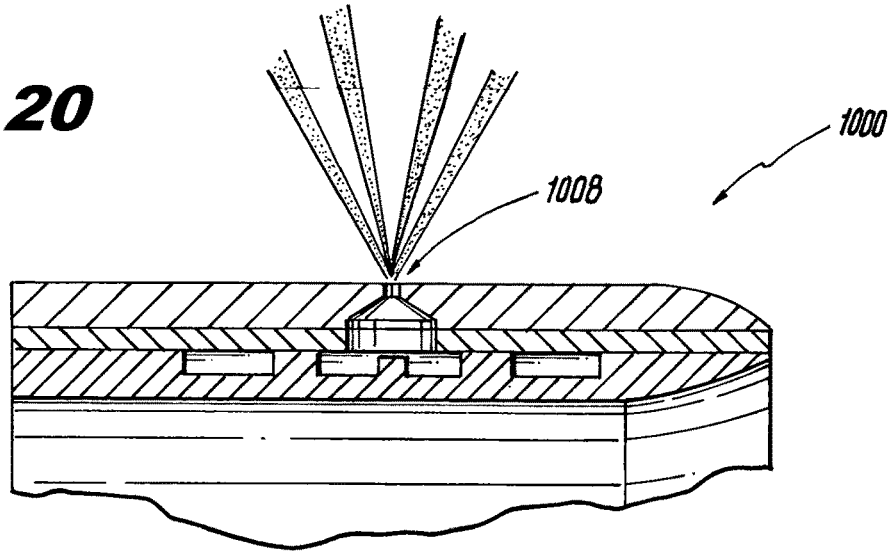
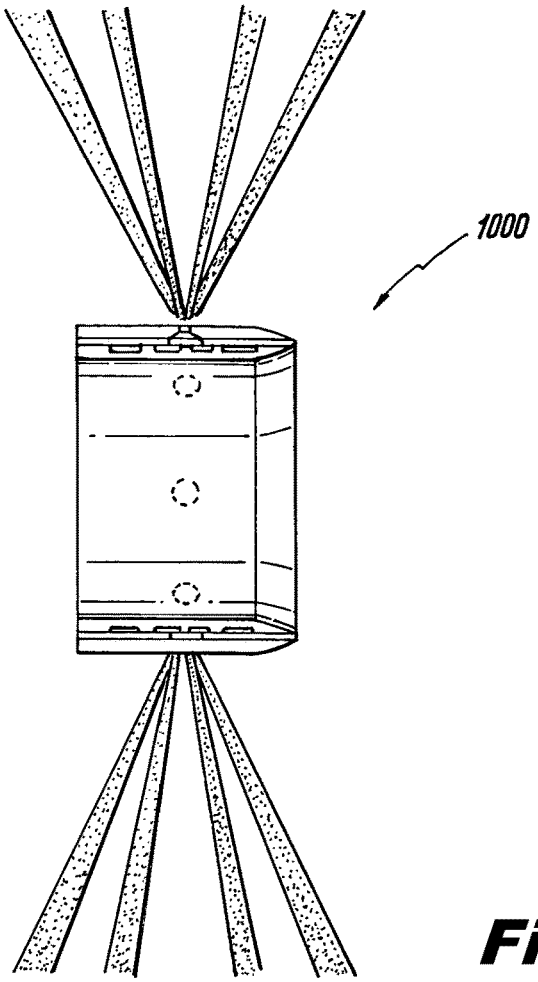
Fig. 21

VARIABLE ANGLE MULTI-POINT INJECTION

CROSS-REFERENCE TO RELATED APPLICATIONS

This application is a divisional of U.S. patent application Ser. No. 13/767,402 filed Feb. 14, 2013, which claims priority to U.S. Provisional Patent Application No. 61/599,659 filed Feb. 16, 2012, each of which is incorporated by reference herein in its entirety.

BACKGROUND OF THE INVENTION

1. Field of the Invention

The present invention relates to liquid injection and atomization, and more particularly to multi-point fuel injection such as in gas turbine engines.

2. Description of Related Art

A variety of devices are known for injecting or spraying liquids, and for atomizing liquids into sprays of fine droplets, such as for gas turbine engines. Improvements in spray patternation have been made by recent developments in multi-point injection, in which a single injector will include multiple individual injection orifices. Exemplary advances in multi-point injection are described in commonly assigned U.S. Patent Application Publications No. 2011/0031333 and 2012/0292408. These designs employ swirl features formed or machined in injector components to generate swirl in flows of liquid and/or air issuing from each injection point.

In a more general aspect, it is desirable in many applications for the spray angle of a nozzle or injector to change during operation. For example, during start up of a gas turbine engine, it is desirable for fuel nozzles to have a wide spray angle in order to position fuel flow in proximity with igniters, which are typically on the periphery of the surrounding combustor. After combustion has been initiated, it may be desirable to have a narrower spray angle to achieve deeper spray penetration into the combustor. These two different spray angles can be accomplished using nozzles with two stages, each having a different spray angle. The extra components required to produce the two stages require envelope space and add to part count. It may also be possible to change the spray angle by physically changing the nozzle geometry. This approach has not become main stream, due to the complications of actuating components to change the nozzle geometry within the combustion environment.

Such conventional methods and systems have generally been considered satisfactory for their intended purpose. However, there is still a need in the art for multi-point injection that provides swirling flows with simplified geometry and manufacturing. There also remains a need in the art for simplified nozzles and injectors that can change spray angle during operation. The present invention provides a solution for these problems.

SUMMARY OF THE INVENTION

The subject invention is directed to a new and useful nozzle for injecting liquid. The nozzle includes a nozzle body defining a circuitous flow channel and a swirl ante-chamber in fluid communication with the flow channel. An injection point orifice is defined in the swirl ante-chamber. The flow channel feeds into the swirl ante-chamber to impart a tangential flow component on fluids entering the swirl ante-chamber to generate swirl on a spray issuing from the injection point orifice.

In certain embodiments, a backing member is mounted to the nozzle body. The backing member includes a fluid inlet chamber. The backing member also includes one or more flow passages defined through the backing member for fluid communication from the fluid inlet chamber of the backing member to the flow channel of the nozzle body. The one or more flow passages are angled to impart a direction on flow into the flow channel.

Certain embodiments include a second flow channel in fluid communication with the swirl ante-chamber. The second flow channel feeds into the swirl ante-chamber to impart a tangential flow component on fluids entering the swirl ante-chamber in opposition to, i.e., counter-swirling within the swirl ante-chamber relative to the tangential flow component of the first flow channel entering the swirl ante-chamber, or in cooperation with, i.e., co-swirling with the tangential flow component of the first flow channel. The first flow channel, second flow channel, and swirl ante-chamber are configured and adapted to adjust spray angle of a spray issuing from the injection point orifice by varying flow apportionment among the first and second flow channels. Each flow channel can include one or more tangential swirl slots for receiving liquid and imparting a direction on flow of the liquid in the respective flow channel.

A backing member for embodiments with two flow channels as described above can include a first fluid inlet chamber having one or more flow passages defined through the backing member for fluid communication from the first fluid inlet chamber of the backing member to the first flow channel of the nozzle body. A second fluid inlet chamber having one or more flow passages is defined through the backing member for fluid communication from the second fluid inlet chamber of the backing member to the second flow channel of the nozzle body to change spray angle of the injection point orifice by apportionment of flow between the first and second fluid inlet chambers of the backing member. It is contemplated that the one or more flow passages of the first fluid inlet chamber and the one or more flow passages of the second fluid inlet chamber can be angled for co-swirling flow in the swirl ante-chamber, or for counter-swirling flow.

In accordance with certain embodiments, one or more air assist circuits can be included for air assist atomization of spray from the injection point orifice. An air assist circuit can be defined by an air inlet extending inside the swirl ante-chamber. A prefilmer can be formed between the air inlet and a prefilming surface of the swirl ante-chamber.

It is also contemplated that a prefilmer can be positioned downstream of the injection point orifice. Such a prefilmer can be configured and adapted for prefilming impingement of spray from the injection point orifice.

In certain embodiments, additional swirl ante-chambers can be included, each having a separate injection point orifice, each swirl ante-chamber being in fluid communication with the first and second flow channels. The swirl ante-chambers can be aligned in a straight line with one another. It is also contemplated that certain embodiments can provide for more than one injection stage. For example, a second plurality of swirl ante-chambers and corresponding injection point orifices can be provided in fluid communication with the second flow channel described above. A third flow channel can be provided in fluid communication with the second plurality of swirl ante-chambers for separate spray angle control of the first and second pluralities of swirl ante-chambers.

In embodiments having multiple swirl ante-chambers and injection point orifices, the swirl ante-chambers and injection point orifices can all be aligned parallel to a common axis. Each swirl ante-chamber can be aligned to the respective injection point orifice. The injection point orifices can diverge from one another relative to a common axis. It is also contemplated that the injection point orifices can be directed radially outward relative to a common axis.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 20 is a cross-sectional side elevation view of the nozzle of FIG. 19, showing a spray from the outlet orifice schematically;

FIG. 21 is a schematic cross-sectional side elevation view of the nozzle of FIG. 19, showing the flow paths and sprays for multiple radial outlet orifices;

DETAILED DESCRIPTION OF THE PREFERRED EMBODIMENTS

Figure 1:
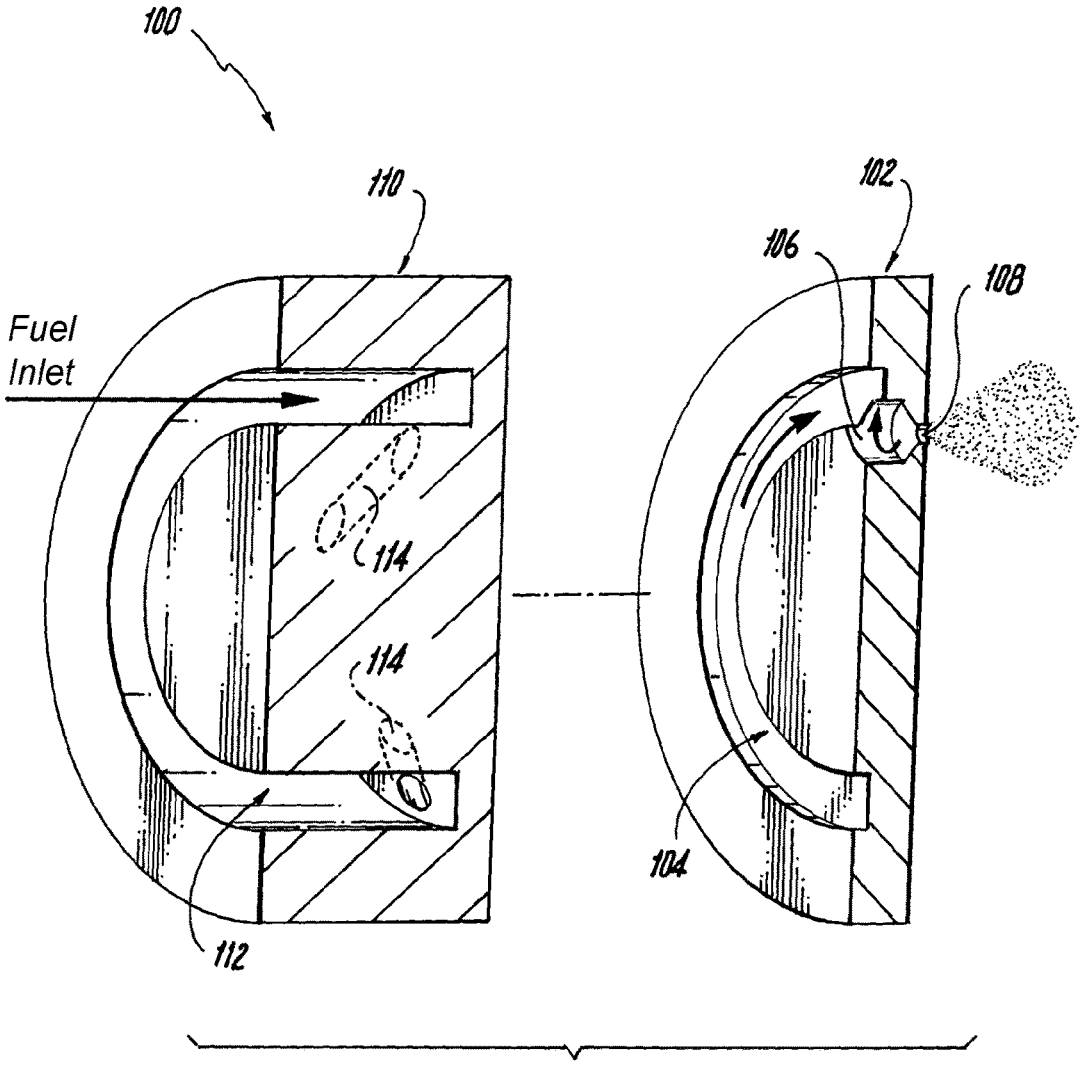
FIG. 1 is an exploded cross-sectional perspective view of an exemplary embodiment of a nozzle constructed in accordance with the present invention, showing the nozzle body and backing member separated.

Reference will now be made to the drawings wherein like reference numerals identify similar structural features or aspects of the subject invention. For purposes of explanation and illustration, and not limitation, a partial view of an exemplary embodiment of a nozzle in accordance with the invention is shown in FIG. 1 and is designated generally by reference character 100. Other embodiments of nozzles in accordance with the invention, or aspects thereof, are provided in FIGS. 2-25, as will be described. The systems and methods of the invention can be used for simplified swirler geometry, and for control of variable spray angle based on flow apportionment to multiple flow passages.

Nozzle 100 includes a nozzle body 102 in the form of a plate defining a circuitous flow channel 104 and a swirl ante-chamber 106 in fluid communication with flow channel 104. An injection point orifice 108 is defined in the swirl ante-chamber 106. Flow channel 104 feeds a flow into the swirl ante-chamber 106 in an off-center manner to impart a tangential flow component on fluids entering swirl ante-chamber 106 to generate swirl on a spray issuing from injection point orifice 108. A backing member 110 is mounted to nozzle body 102, e.g., nozzle body 102 is a front plate and backing member 110 is a back plate as oriented in FIG. 1. Backing member 110 includes a fluid inlet chamber 112. The backing member also includes four flow passages 114, two of which are shown schematically in FIG. 1, defined through backing member 110 for fluid communication from fluid inlet chamber 112 to flow channel 104 of nozzle body 102. Passages 114 are angled to impart a direction on flow into flow channel 104, as indicated by the clockwise flow arrow in flow channel 104 of FIG. 1.

This geometry is generalized by geometry in which the liquid is given a directional bias from features in the geometry, i.e., passages 114 which could be holes, slots, or the like, which enter into one or more separate passages, i.e., flow channel 104. The flow feeds from flow channel 104 into swirl ante-chamber 106 with a bias in direction, so as to impart swirl on fluids flowing into swirl ante-chamber 106. The flow continues to spin before finally exiting out of orifice 108. Multiple swirl ante-chambers and respective orifices may be used for multi-point injection. Note that for simplicity only one the fuel circuit is shown in FIG. 1, and other fuel/air circuits are described below.

The configuration in FIG. 1 represents a simplification in swirler geometry compared to conventional swirlers which translates into simplified manufacture. Intricate swirl slots or the like are not required as in traditional swirlers. In a traditional single or multi-point injector, very small passages are utilized to impart swirl into the swirl ante-chamber(s). With nozzle 100, the direction is imparted on the flow by larger features (slots, holes, etc. . . . ) and also directed into the swirl ante-chamber 106, with directional bias, which imparts swirl into the flow without the need of very small passages. Some advantages of the increased passage sizes can include the following.

1. The increased passage sizes are an advantage in terms of operability, for example being less susceptible to clogging.

2. The increased passage sizes are an advantage in terms of manufacturability. The sensitivity to machining tolerances is reduced. For example a 0.020" (0.051 cm) slot is much more sensitive to a 0.001" (0.003 cm) tolerance than a 0.040" (0.10 cm) slot. This allows for a more consistently manufactured product.

3. The increased passage sizes, and the accompanying reduced sensitivity to machining tolerances, also allow for more consistent additive manufacturing. Since the features which impart direction to the flow are larger, they are not as sensitive to abnormal surface finishes and manufacturing imperfections as smaller features found in traditional injection devices. This means nozzles such as nozzle 100 are better candidates than traditional nozzles or injectors for additive manufacturing where the surface finish is not as smooth as other forms of manufacturing and where there is an elevated possibility of manufacturing imperfections.

4. The increased passage sizes also lend themselves to a better handling of heavy fuels and alternative fuels than in traditional injectors and nozzles. Since the passage sizes are increased, problems associated with gumming of fuels or coking within the fuel circuit should not have as much of an influence as traditional injection devices with small passages.

5. Potential fluid dynamic advantages include larger flow ports producing less flow growth. Flow growth is a typical effect of temperature on viscosity that can result in changes in flow number and/or spray angle. This effect of variation in spray angle or flow number may be reduced with the configuration of nozzle 100.

In addition to the potential advantages above, the exemplary embodiment in nozzle 100 can enjoy various advantages over traditional multipoint nozzles. A traditional multipoint nozzle has a number of small milled slots at the entrance to each swirl ante-chamber. Nozzle 100 represents a significant reduction in the complexity of the part. Some advantages of reduced complexity can include the following.

1. Lower cost in terms of machining time is achieved by reducing the number of operations per point. Traditional multipoint nozzles use two or more slots per injection point where nozzle 100 has only one directional feature per injection point.

2. There is a reduced need for very small cutting tools, which reduces overall tooling cost.

3. The number of piece-parts is reduced. There are two parts in nozzle 100 (e.g., the front and back plate) compared to the traditional 3-4 or more complex parts in a traditional multi-point injector.

4. Simplicity in design also allows for additional flexibility in the placement of the injection points to fit the geometry of the combustor, as will be described with respect to FIG. 13.

Figure 2:
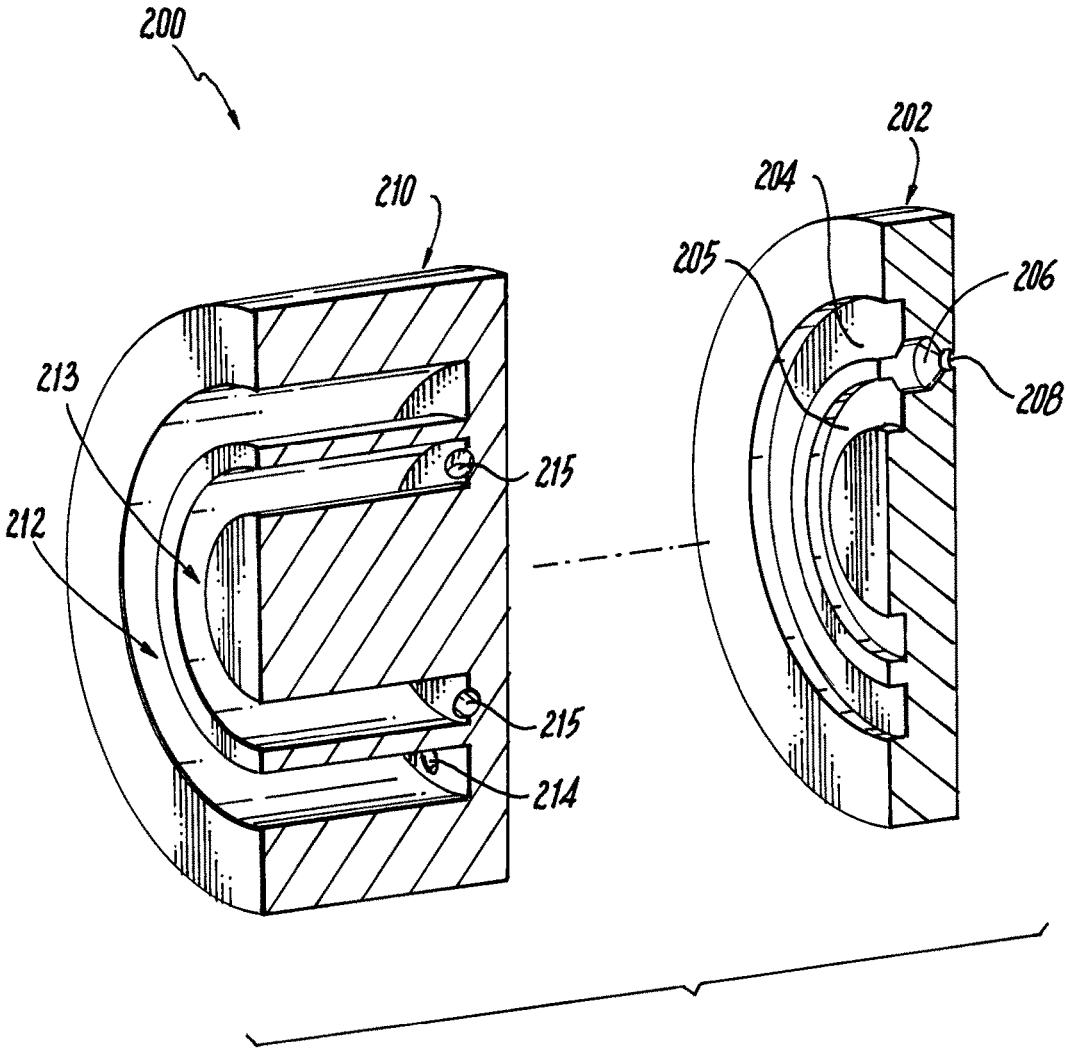
FIG. 2 is an exploded cross-sectional perspective view of another exemplary embodiment of a nozzle constructed in accordance with the present invention, showing two separate flow paths feeding into the swirl ante-chamber for swirl direction control through apportionment of flow between the two flow paths.
Figure 3:
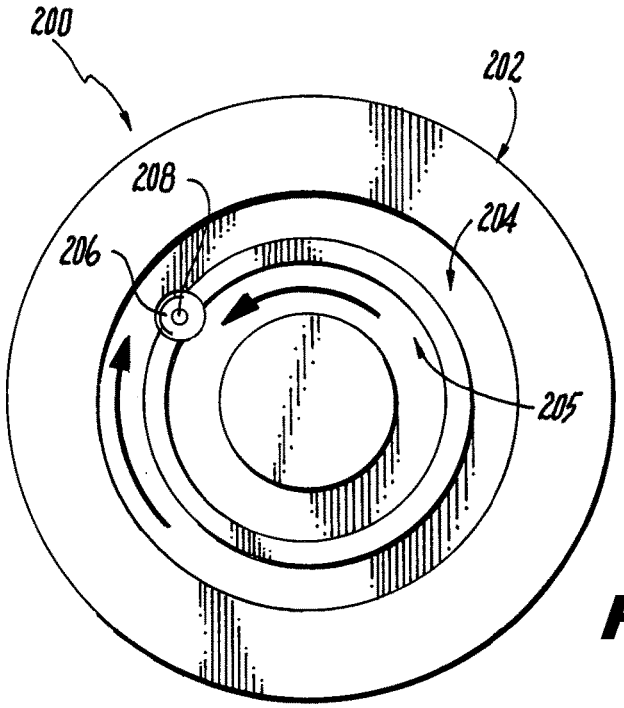
FIG. 3 is an inlet end view of the nozzle body of FIG. 2, showing flows leading into the swirl ante-chamber that enhance swirl.
Figure 4:
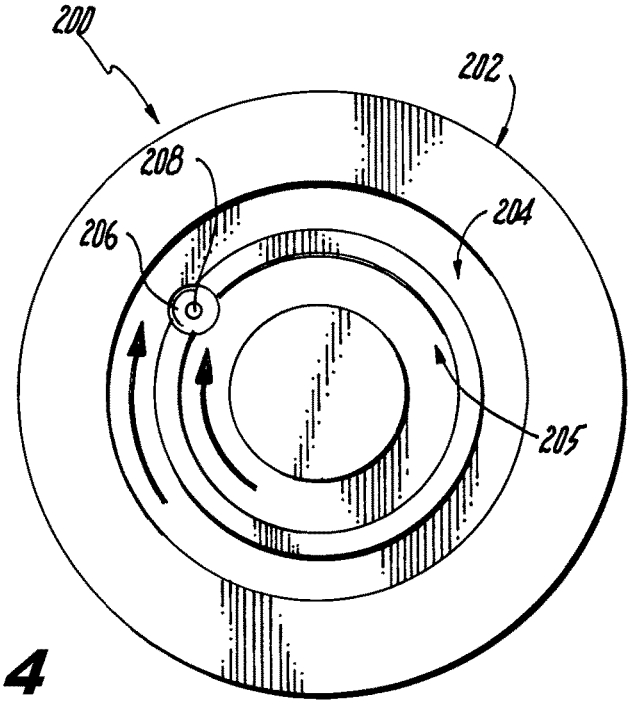
FIG. 4 is an inlet end view of the nozzle body of FIG. 2, showing flows leading into the swirl ante-chamber that reduce swirl.

With reference now to FIG. 2, using multiple flow channels to feed a swirl ante-chamber allows for fluidic control of spray angle. Nozzle 200 has a nozzle body 202, backing member 210, flow channel 204, swirl antechamber 206, injection point orifice 208, fluid inlet chamber 212, and passages 214 much as described above with respect to FIG. 1. In addition, nozzle 200 includes a second annular flow channel 205 inboard of the first flow channel 204. Nozzle 200 also includes a second fluid inlet chamber 213 inboard of the first inlet chamber 212. Inlet chamber 213 includes passages 215 that can be configured to generate a flow in flow channel 205 that co-swirls or counter-swirls with flow in flow channel 204. Thus the direction of flow in the separate passages as they feed into the swirl ante-chamber may be directed either to aid swirl in the swirl ante-chamber 206 or may weaken the amount of swirl, depending on the respective angles of passages 214 and 215. FIGS. 2-4 only show one swirl ante-chamber 206 and orifice 208 for simplicity, however as will be described below, there are actually four of each.

Referring now to FIG. 3, the flow directions in the circuitous flow channels 204 and 205 are indicated in the case where passages 214 and 215 described above are angled to create co-swirling flow in swirl ante-chamber 206. In this case, flow apportionment between the two flow channels 204 and 205 can be used to control the spray angle issuing from orifice 208. For example, if the total flow is apportioned through flow channel 205, with no flow through flow channel 204, a base spray angle will be produced. If flow is apportioned with half of the flow through each channel 204 and 205, then the swirl will increase and the spray angle will be wider than the base spray angle.

With reference now to FIG. 4, the flow directions in flow channels 204 and 205 are indicated in the case where passages 214 and 215 are angled to create counter-swirling flow in swirl ante-chamber 206. In this case, flow apportionment between the two flow channels 204 and 205 can be used to control the spray angle issuing from orifice 208 as follows. If the total flow is apportioned through flow channel 205, with no flow through flow channel 204, a base spray angle will be produced. If flow is apportioned with half of the flow through each channel 204 and 205, then the swirl will be decreased and the spray angle will be narrower than the base spray angle.

In addition to the potential advantages described above with respect to nozzle 100, nozzle 200 can provide the advantage of variable swirl angle ability. With two or more channels feeding into the swirl ante-chambers, if the directional geometry is set to counter-swirl into the swirl ante-chambers, there is a large degree of controllability on the swirl angle. For example, fixing the total flow rate into the injector (say 100 lb/hr or 0.756 kg/s), if all of the flow goes through only 1 of the 2 channels, it will give a certain spray angle out of the exit orifice(s), for example 60°. If the flow is split evenly between both channels, e.g., 50 lb/hr (0.38 kg/s) in each channel for 100 lb/hr (0.756 kg/s) total injector flow, then the spray angles out of the exit orifice(s) will be reduced because of the opposite swirl directions feeding into the swirl ante-chambers. This swirl angle can be completely controlled by controlling the flow split between the channels.

Advantages of variable swirl angle can include the following.

1. Complete control over swirl angle can have a large number of advantages, for example in gas turbine engines. One advantage can be the ability to put fuel exactly where it needs to be at every desired flow rate of the injector. For example, it may be desired to have a wide spray angle at an ignition flow rate to place the fuel near the ignition source. Then as the nozzle runs at an idle, cruise, or takeoff flow rate, the spray angles can be tailored to give best performance of the nozzle in terms of emissions, efficiency, stability, and the like.

2. A novel feature of nozzle 200 is that the variable angle spray is controlled fluidically and not mechanically. This can give it the advantage of non-complex geometry inside the nozzle compared to mechanically actuated features, for example. This also allows for very fast adjustment of spray angles, which can be important for active combustion control techniques, for example. The spray angle adjusts instantaneously with a change in fuel flow splits in the manifold.

Figure 5:
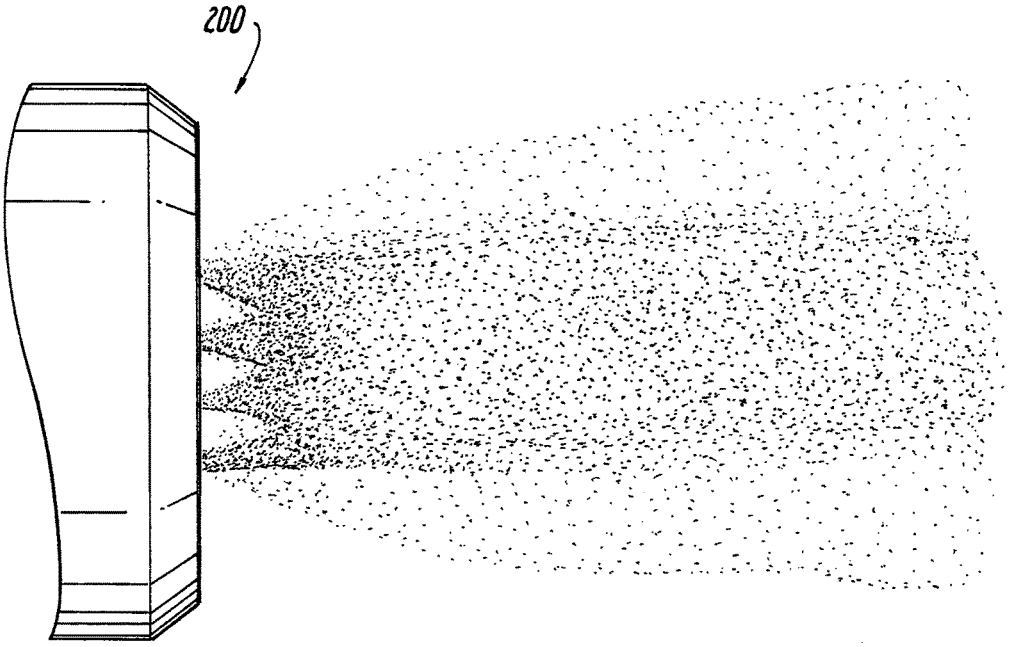
FIGS. 5 and 6 are side views of a portion of the nozzle of FIG. 2, showing a spray issued at first and second spray angles, respectively, wherein the change in spray angle is controlled by apportionment of flow through the two flow paths.
Figure 6:
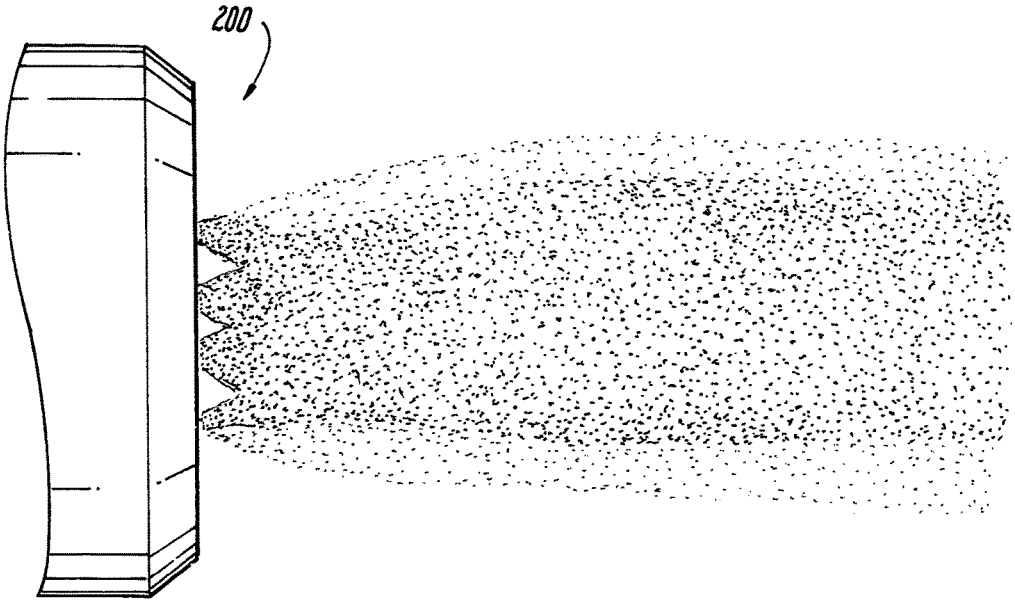

With reference now to FIGS. 5-6, nozzle 200 with two flow channels 204 and 205 demonstrate variable spray angle. This geometry has a flow number of roughly 12 with four separate multi-point injection orifices. There is no outlet conic on the injection points, so the images in FIGS. 5-6 show the natural cone angles. FIG. 5 shows the degree of controllability—at a constant pressure (100 psi or 689 kPa), the spray angles can be varied from about 55° degrees down to a spray angle of about 25° in FIG. 6. FIGS. 5 and 6 show the same nozzle 200, both with overall pressure at 100 psi (689 kPa). FIG. 5 shows the spray when 100% of the flow is through only one channel. FIG. 6 shows the spray when the flow is split roughly evenly between the two flow channels 204 and 205. There can be a slight skew on individual injection points present at low flow rates when the channels are fed from a single side, meaning the ante-chamber is fed by only one channel 204. However, since nozzle 200 is a multi-point design, the overall injector will not be skewed if individual points are all skewed the same way.

While described above in the exemplary context of fuel injection, those skilled in the art will readily appreciate that any suitable fluid can be swirled as described above. For example, the principles used to swirl fluids in injectors 100 and 200 can similarly be used for controlling air. In such applications, air is split into two separate inlet chambers, which respectively feed into similarly oriented directional passages. This allows for the air flow angle to be controlled fluidically, very similar to the way the liquid spray angle is controlled in nozzle 200.

Figure 7:
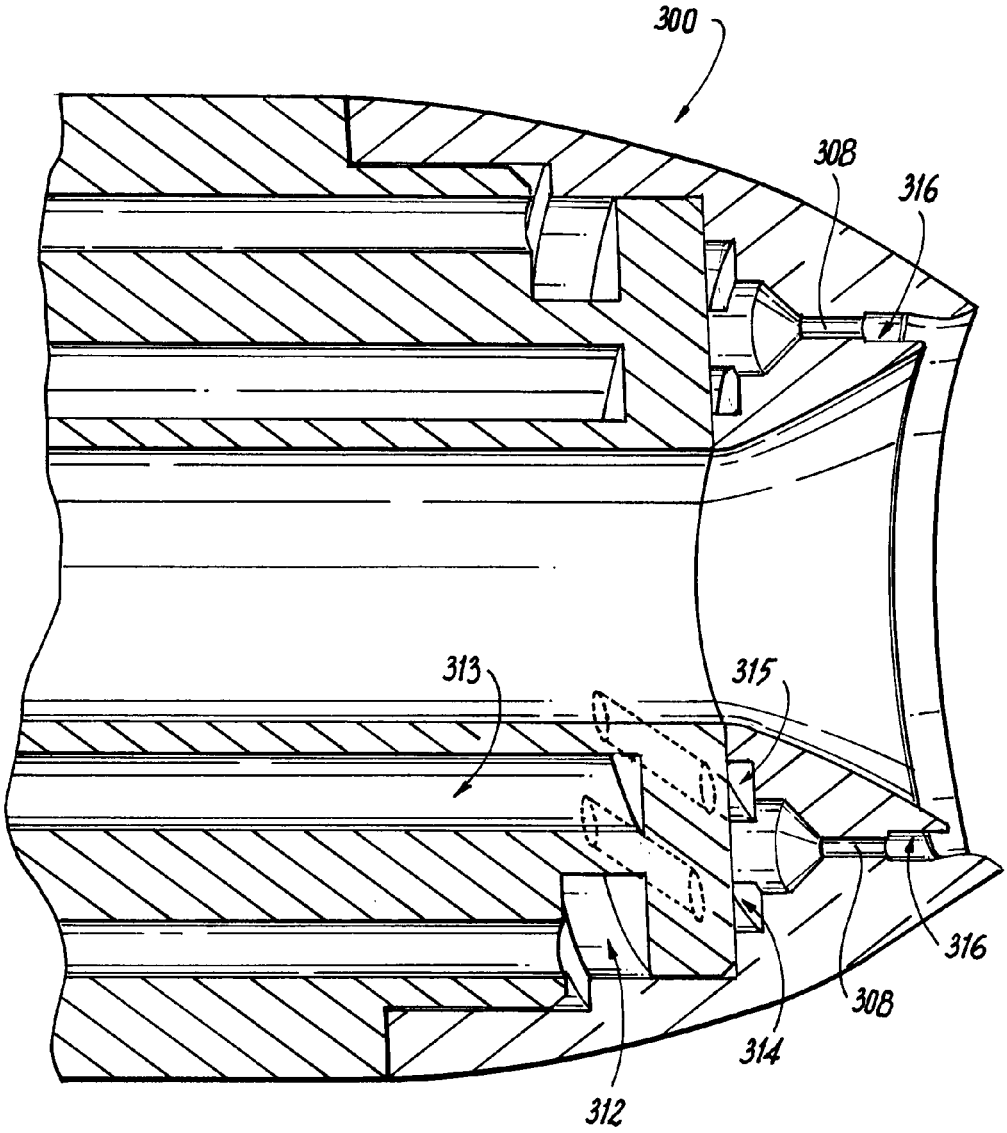
FIG. 7 is a cross-sectional perspective view of another exemplary embodiment of a nozzle constructed in accordance with the present invention, showing an inner air circuit for airblast atomization of spray from the nozzle body.

With reference now to FIG. 7, the simplicity of design coupled with the controllability of the spray angle lends itself well to an advanced fuel delivery configuration for use in airblast injectors. Injector 300 includes inlet chambers 312 and 313 and respective flow passages 314 and 315 which operate as described above. In injector 300, instead of each point in the multipoint nozzles 200 described above being the ultimate outlet, the exit orifices 308 are upstream of a prefilming surface 316. The spray from orifices 308 is allowed to film along a prefilming surface 316. One advantage of this configuration over a traditional fuel system can be the ability to fluidically control the hydraulic spray angle of the circuit, which can have similar advantages as previously listed for the multipoint injector, but within an airblast design.

Figure 8:
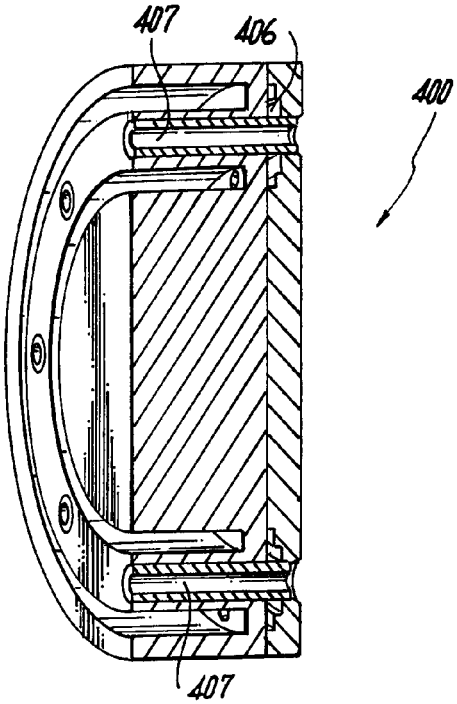
FIG. 8 is a cross-sectional perspective view of another exemplary embodiment of a nozzle constructed in accordance with the present invention, showing air inlets for air assist atomization in each injection point of the nozzle body.
Figure 9:
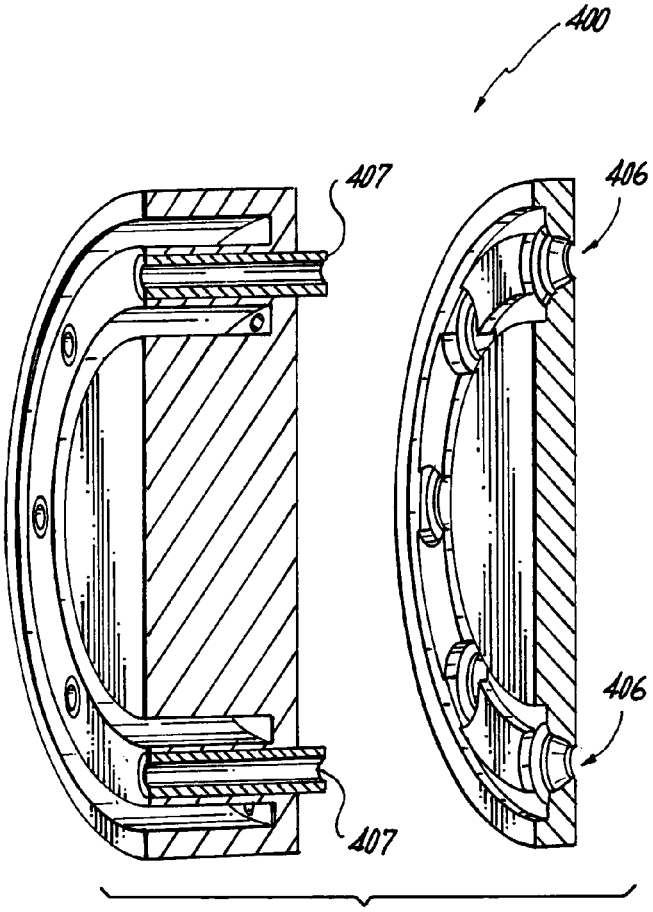
FIG. 9 is an exploded cross-sectional perspective view of the nozzle of FIG. 8, showing the swirl ante-chambers in the upstream face of the nozzle body.
Figure 10:
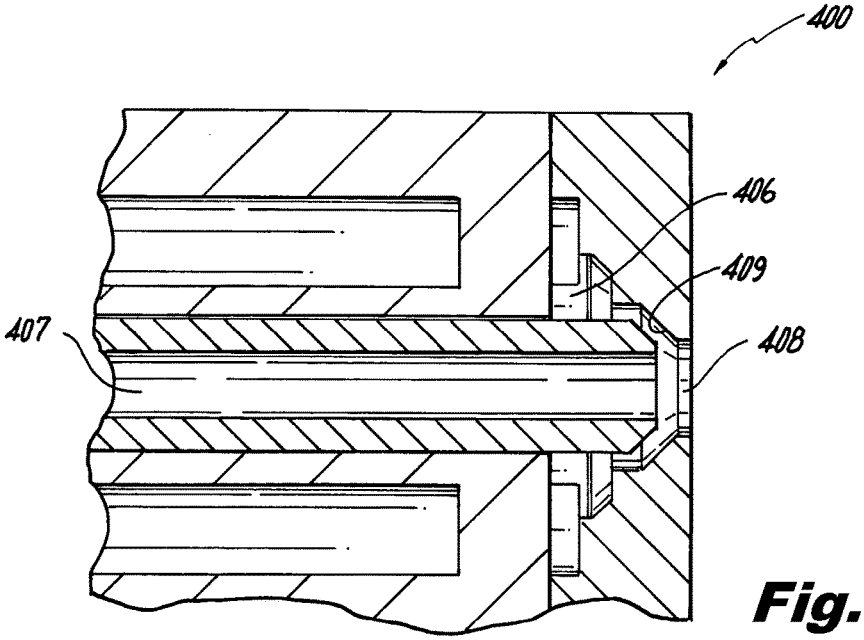
FIG. 10 is cross-sectional side elevation view of a portion of the nozzle of FIG. 8, showing the fuel and air flow paths leading into one of the swirl ante-chambers.

Referring now to FIG. 8, the simplicity in design of the exemplary embodiments described herein allow for a straight forward application where each point of the multipoint injector be an individual air-assist point, which may be referred to as a multi-air-assist point injector. In injector 400, this can be accomplished by putting one or more air channels 407 down the center of each swirl ante-chamber 406. Air channels 407 are shown separated from their respective swirl ante-chambers 406 in FIG. 9. The fuel channels add swirl into swirl ante-chambers 406 in a similar way to that described above with respect to nozzle 200. With reference to FIG. 10, the flow swirls in swirl ante-chamber 406 and may then film along a filming surface 409 where it then meets up with the inner air from air channel 407 at orifice 408 and air from outer air channels. The outer air channels are not shown in FIGS. 8-10 for simplicity, but see, e.g., FIGS. 7 and 17.

Figure 11:
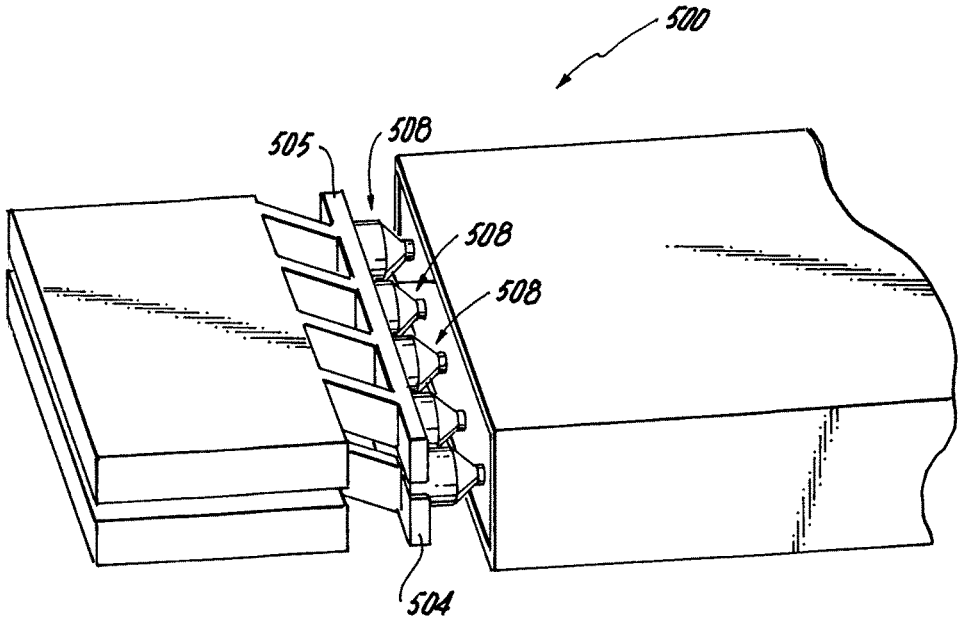
FIG. 11 is a schematic perspective view showing a negative rendering (flow cavities as solids) of another exemplary embodiment of a nozzle constructed in accordance with the present invention, showing multiple swirl ante-chambers and respective outlet orifices aligned in a line.
Figure 12:
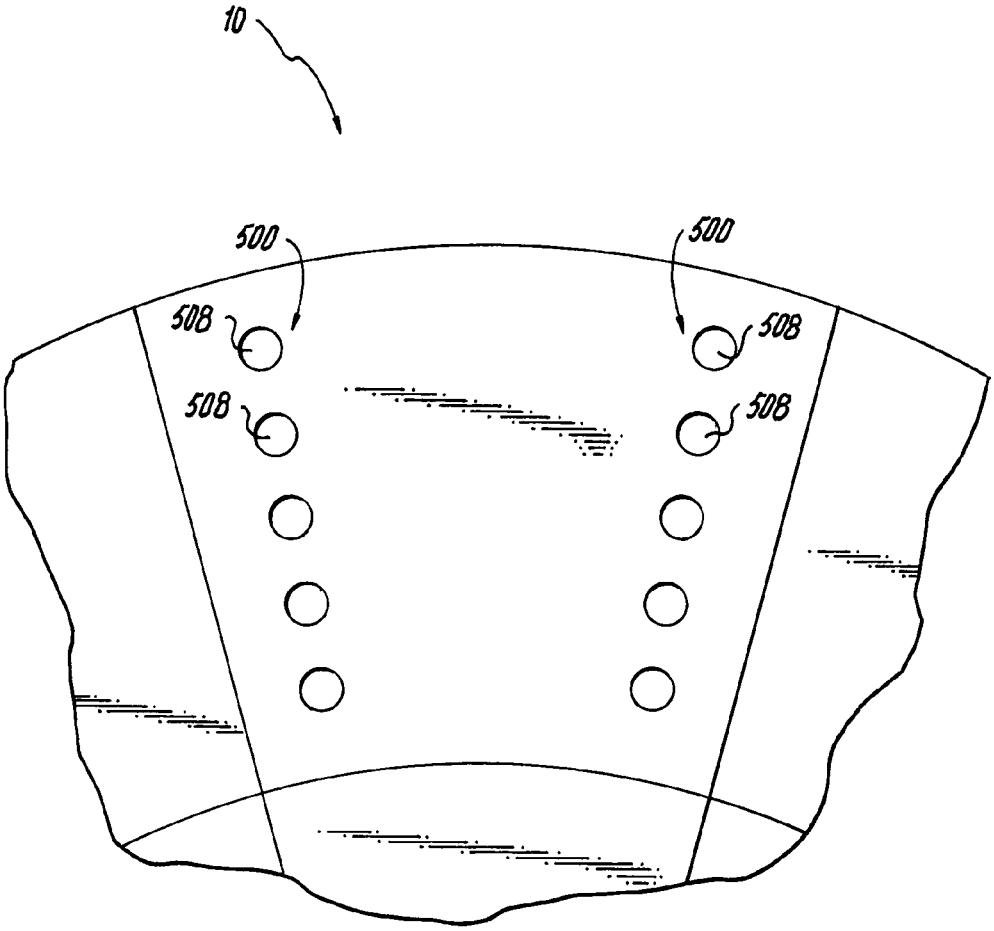
FIG. 12 is a schematic outlet end view of two nozzles of FIG. 11 arranged around a combustor in a circumferentially spaced apart array for multipoint injection.
Figure 13:
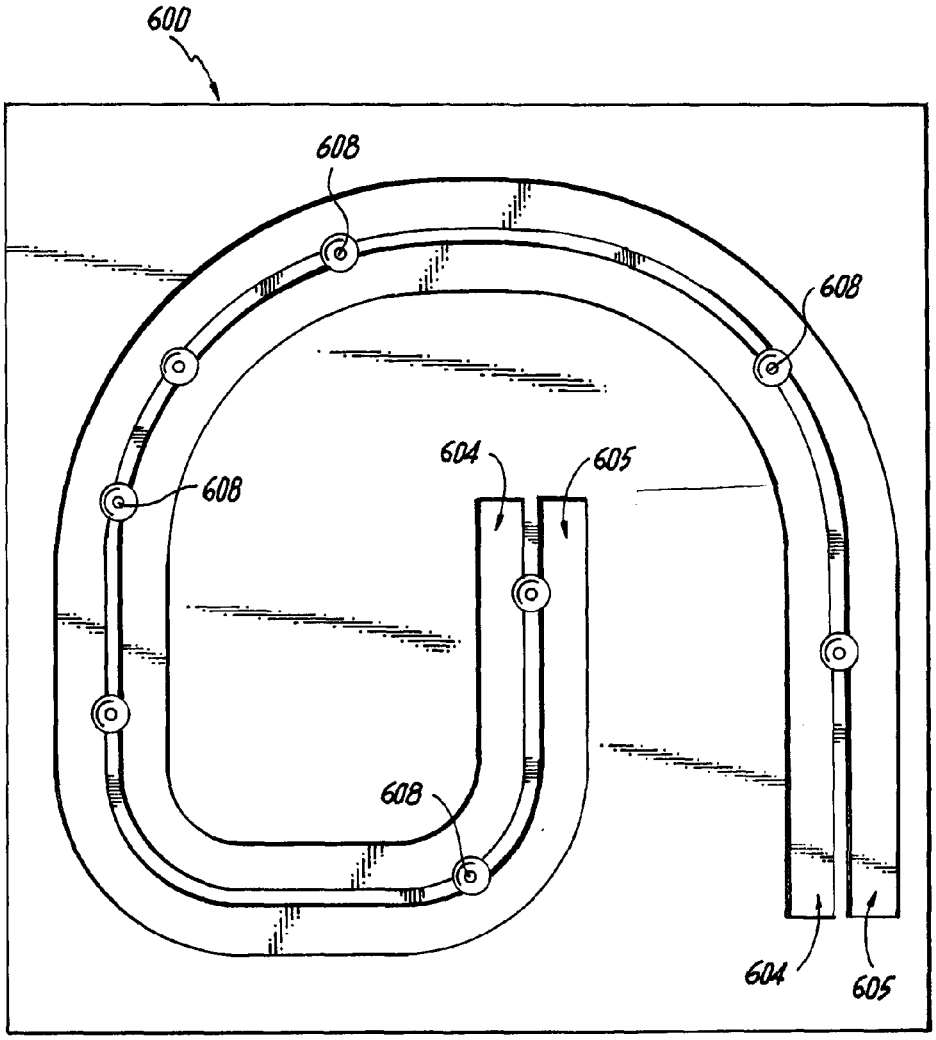
FIG. 13 is a schematic inlet end view of another exemplary embodiment of a nozzle constructed in accordance with the present invention, showing an arbitrary array of swirl ante-chambers and respective outlet orifices with two respective flow paths leading to each swirl ante-chamber.

Due to the simplicity of the exemplary embodiments described herein, there exists the ability to design the locations of the exit points, i.e., injection point orifices, to suit the needs of specific applications such as particular combustion devices. FIGS. 11-13 show examples of the ease of designing the location of the exit points any way that will best fit particular applications. After the exit point locations are determined, the channels may then be located and sized to fit the exit points. Those skilled in the art will readily appreciate that this allows great flexibility in design. FIG. 11 shows a negative rendering (flow cavities shown as solid) of a multi-point injector 500 with a linear pattern of injection point orifices 508. Flow channels 504 and 505 operate much as those described above with respect to nozzle 200 to control the spray issuing from orifices 508. As shown schematically in FIG. 12, this linear configuration allows multiple injection point orifices 508 to be oriented and attached on a single feed arm and attached externally around a full annular combustor 10. Two multi-point injectors 500 are shown schematically mounted to combustor 10 in FIG. 12 for simplicity, however, multiple injectors 500 could be mounted to fill the entire circumference around combustor 10. FIG. 13 shows another example of the flexibility of exit point location in accordance with the present invention. In injector 600, eight injection point orifices 608 are arranged in an arbitrary pattern, and the two flow channels 604 and 605 are routed accordingly. In gas turbine engines, for example, the flexibility to have arbitrarily designed fuel passages can help to optimize thermal-management, emissions, operability, and the like.

Spray angle control as described herein provides the potential for improved advanced active combustion control. Since the spray angle can be controlled fluidically instead of mechanically, a faster response time can be achieved than in other active combustion control devices. This can be realized by changing the spray angles in a controlled method to counteract unwanted thermal-acoustic instabilities, i.e. rumble, without the need to change the overall mass flow rate of the injector, but instead by simply adjusting the flow splits between flow channels. Additionally, due to the fluidic control of exemplary embodiments described herein, it may be possible to find a fluidically controllable instability, which could also be used to control the unwanted thermal-acoustic instabilities.

In addition to the two flow channel embodiments described above, additional flow channels may be added to change features of the spray including spray quality, multi-fuel (gas or liquid) ability, and the like. These channels can meet in the directional passages or in the swirl ante-chamber depending on the intent of the design.

Figure 14:
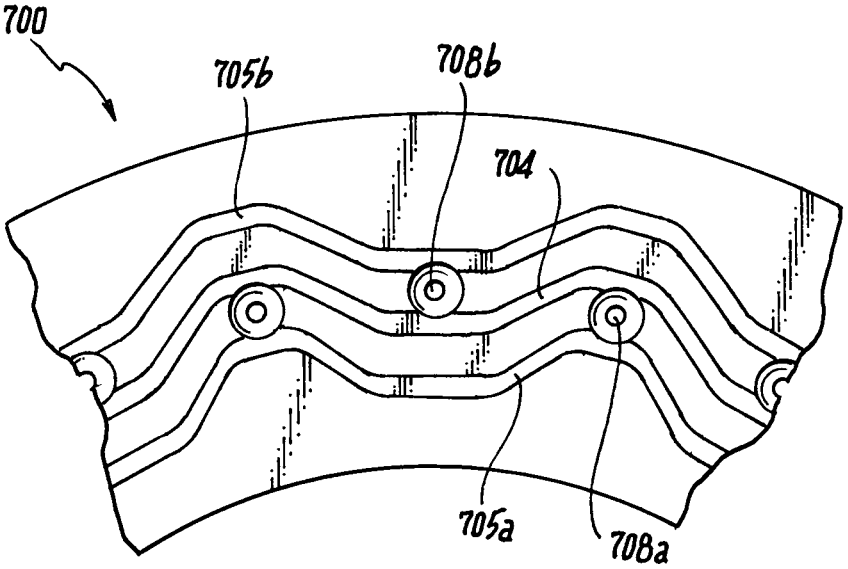
FIG. 14 is a schematic inlet end view of another exemplary embodiment of a nozzle constructed in accordance with the present invention, showing three flow paths and two sets of swirl ante-chambers, wherein one of the flow paths is in fluid communication with both sets of swirl ante-chambers, and wherein the other two swirl flow paths are each only in fluid communication with a respective one of the two sets of swirl ante-chambers for injection staging and spray angle control by apportionment of flow among the three flow paths.

One application for more than two flow channels is in staging of injection points, as when staging fuel injection in gas turbine engines. Due to the simplified geometry described above for introducing swirl into swirl ante-chambers, various channels can be used to allow certain points in the multi-point injector to be controlled, either in an on/off or controlled flow rate just by adding additional channels. For instance, FIG. 14 shows a schematic of an injector 700 for staging multiple injector points. In injector 700, the spray angle of alternating injection points can be independently controlled. A first set of injection points 708*a* alternates circumferentially around injector 700 with a second set of injection points 708*b*. One flow channel 704 feeds both sets of injection points 708*a* and 708*b*. A second flow channel 705*a* feeds only injection points 708*a*, and a third flow channel 705*b* feeds only injection points 708*b*. Changing the apportionment of flow among the three flow channels 704, 705*a*, and 705*b* allows separate staging and spray angle control of injection points 708*a* and 708*b*. Similar channel configurations can be used instead to control individual duplex channels or air-assist atomizer points in addition to simplex injector points. It is also contemplated that providing four flow channels, two each for two separate sets of injection points, allows for completely independent operation and spray angle control for the two sets of injection points.

Figure 15:
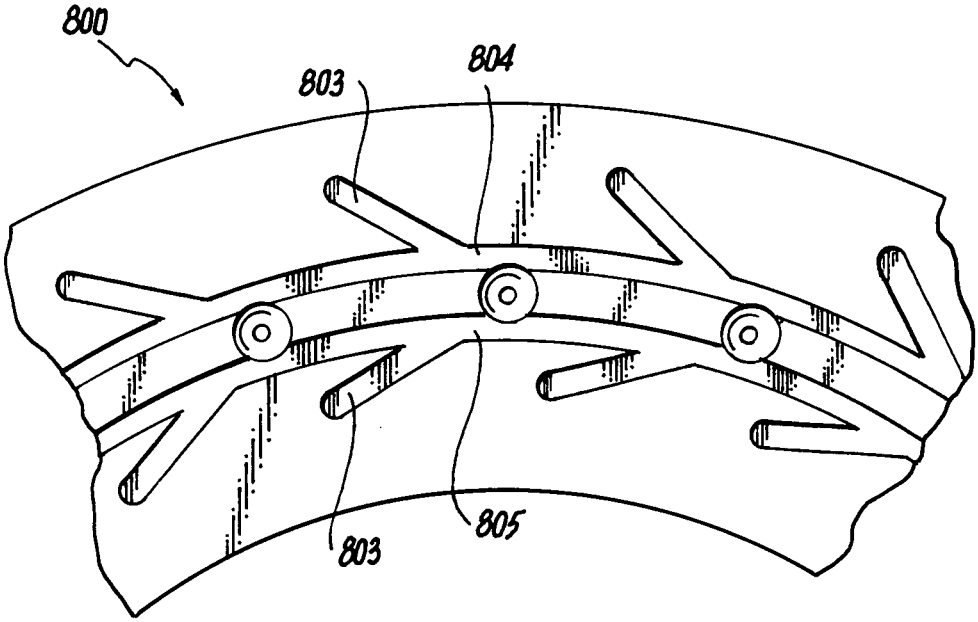
FIG. 15 is a schematic inlet end view of another exemplary embodiment of a nozzle constructed in accordance with the present invention, showing a plurality of swirl slots leading in to each flow path for imparting a direction on flow in each flow path.

With reference now to FIG. 15, most of the examples described above have angled holes, e.g., passages 214 and 215, for imparting the flow direction to the feed channels, e.g., flow channels 204 and 205, which then feed a biased flow into the swirl ante-chambers. There are many additional ways to feed flow channels which may be advantageous for fitting the desired envelope of an injector. In one exemplary embodiment, injector 800 includes swirl slots 803 that impose a tangential component onto flow coming in from an axial direction, for example, to flow in the clockwise direction (as oriented in FIG. 15) around each flow channel 804 and 805. This configuration can be advantageous for use in applications with a stacked, sealed injector structure having multiple stacked plates forming the flow passages, see, e.g., FIGS. 22-25 described below. Those skilled in the art will readily appreciate that injector 800 is exemplary only, and that any other suitable arrangement for imparting flow direction can be used without departing from the spirit and scope of the invention.

Figure 16:
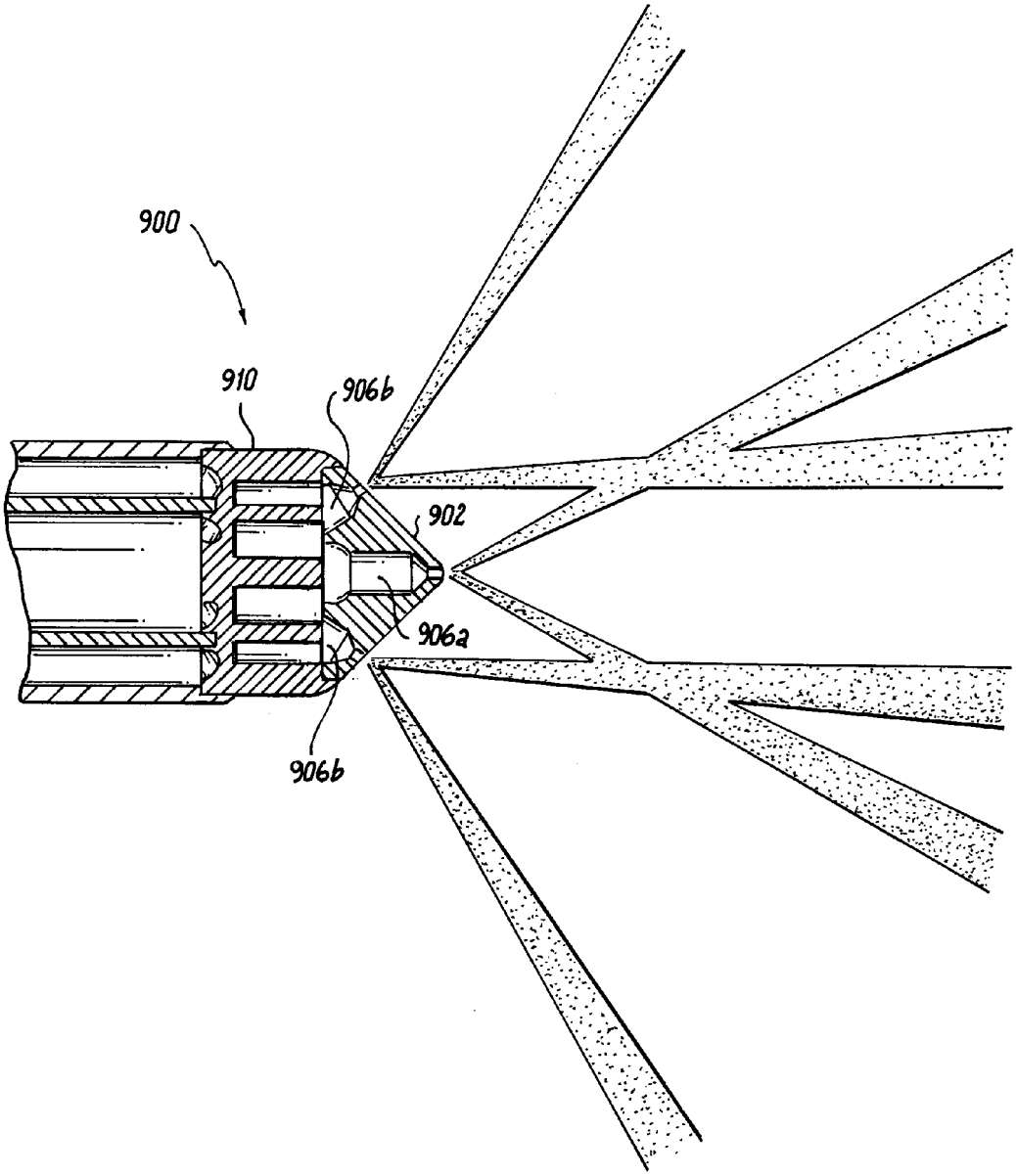
FIG. 16 is a cross-sectional side elevation view of another exemplary embodiment of a nozzle constructed in accordance with the present invention, showing a central, axially oriented swirl ante-chamber and a plurality of diverging swirl ante-chambers.

Referring now to FIG. 16, another exemplary embodiment of an injector 900 includes axial and non-axially oriented injection point orifices and swirl ante-chambers. Nozzle body 902 and backing member 910 supply two-channel fuel supplies to be sprayed, much as described above. A single, central swirl ante-chamber 906*a* is oriented in an axial direction as those described above. A plurality of diverging swirl ante-chambers 906*b* circumferentially surround central swirl ante-chamber 906*a*. Each of swirl ante-chambers 906*b* diverges relative the longitudinal axis of central swirl ante-chamber 906*a*. The respective outlet orifices are shown being aligned with their respective swirl ante-chambers, however, swirl ante-chambers 906*b* are not aligned axially with their underlying flow channels (not labeled in FIG. 16, but see, e.g., flow channels 204 and 205 in FIG. 2). Moreover, it is also possible for a swirl ante-chamber and its orifice to be out of alignment with one another. The centerline outlet orifice can be staged separately from the other outlet orifices as described above with reference to FIG. 14, for example for use as a pilot fuel stage in a gas turbine engine. The overall spray pattern with all the injection points operating is shown schematically in FIG. 16.

Figure 17:
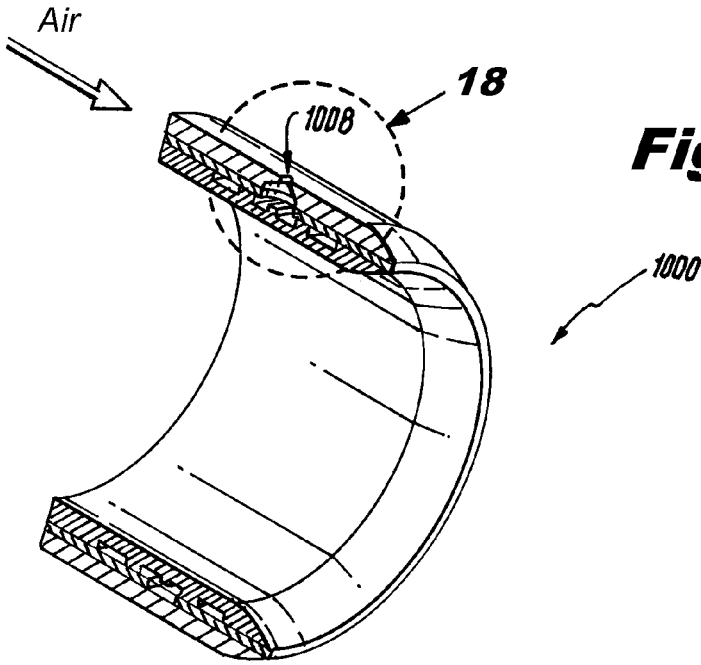
FIG. 17 is a cross-sectional perspective view of another exemplary embodiment of a nozzle constructed in accordance with the present invention, showing one of the radial swirl ante-chambers and the respective outlet orifice.
Figure 18:
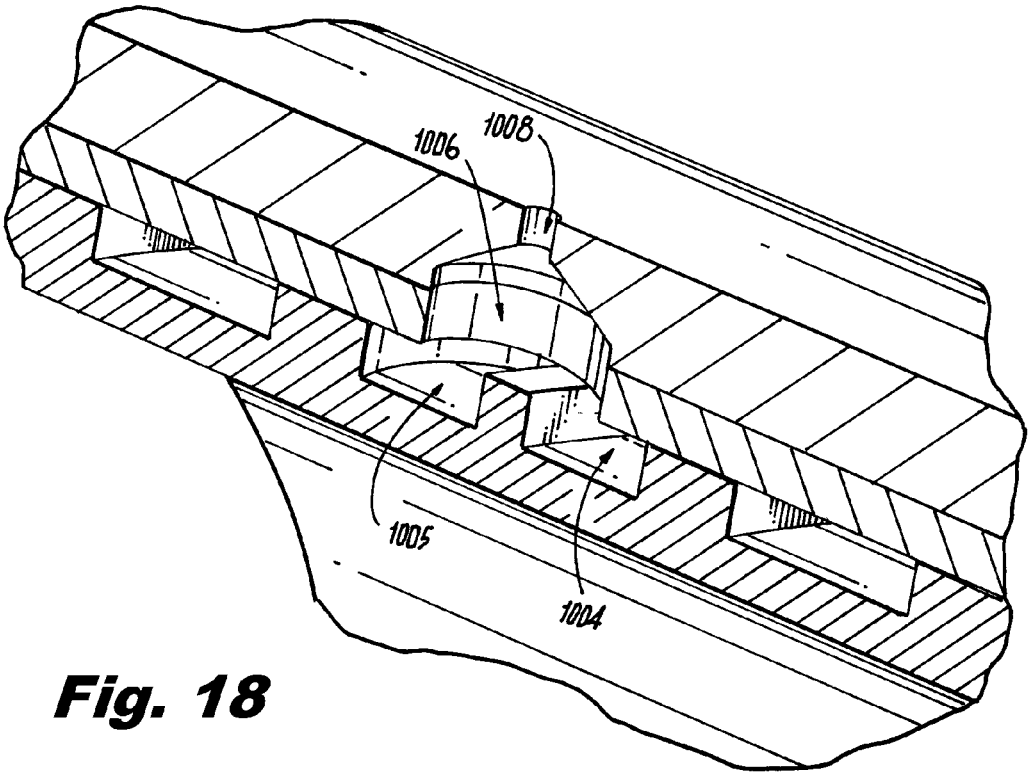
FIG. 18 is an enlarged cross-sectional perspective view of a portion of the nozzle of FIG. 17, showing the two flow paths feeding into the swirl ante-chamber.
Figure 19:
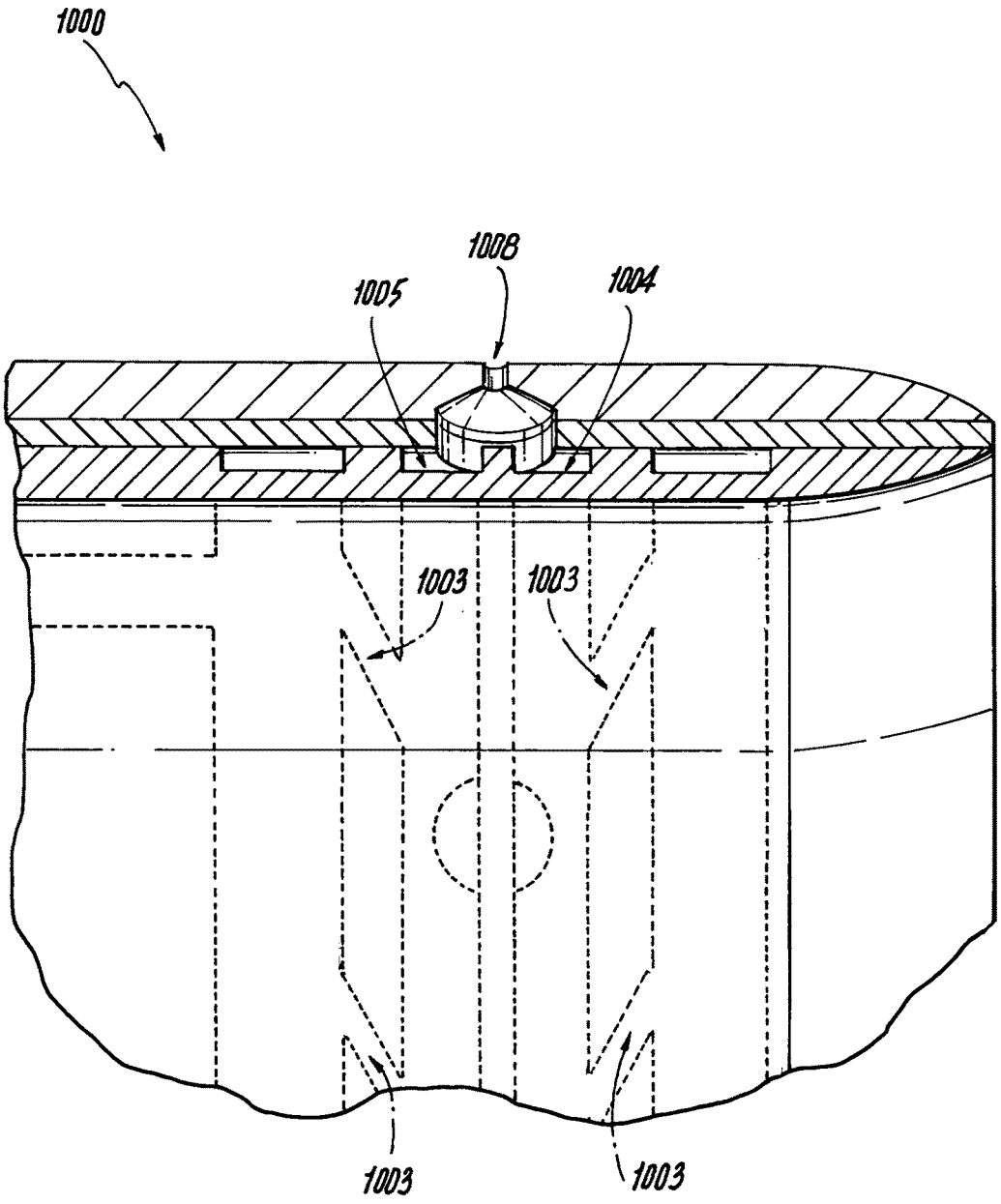
FIG. 19 is a schematic cross-sectional side elevation view of the nozzle of FIG. 17, showing the flow paths schematically.

Making reference now to FIGS. 17-21 the swirl ante-chambers can be oriented radially outward. In injector 1000, the injection point orifices 1008 are oriented to spray radially outward into the air, e.g., as a jet in a cross flow. FIG. 17 schematically shows the cross-flowing air. Swirl ante-chamber 1006 and orifice 1008 are shown enlarged in FIG. 18, where flow channels 1004 and 1005 are shown feeding into swirl ante-chamber 1006. Flow channels 1004 and 1005 are fed by radial slots 1003, as indicated schematically in FIG. 19, which operate much like radial swirl slots 803 described above. FIGS. 20 and 21 schematically show the radially outward spray from a single orifice 1008 and from multiple orifices 1008, respectively. One advantage of radial spray can be to tailor the penetration of the fuel into the air at different engine conditions. For example, in a traditional jet in cross-flow nozzle, the idle condition may be such that the desired mass flow rate of fuel would penetrate completely through the air to the other side and impinge on an outer face of the nozzle (which is undesirable). With injector 1000, the spray angle can be adjusted so it has a wider spray at this condition and does not impinge. At a higher pressure ratio, where the air has a much higher density, the spray angle can be narrowed down to behave similar to a plain jet which allows for further penetration of the fuel into this dense air. Note that it is not necessary for the orifices 1008 to spray directly perpendicular to the direction of air, they may instead be angled off-perpendicular. Those skilled in the art will readily appreciate that the spray angles described above are exemplary, and that any suitable spray angle can be used without departing from the spirit and scope of the invention.

Figure 22:
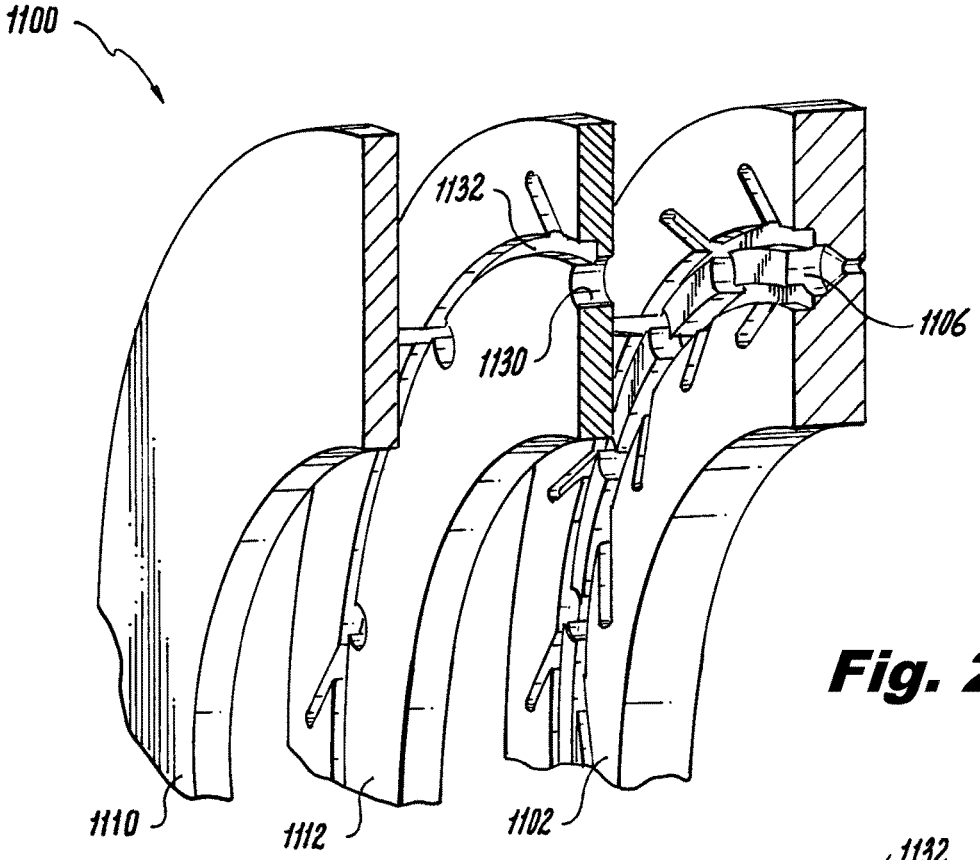
FIG. 22 is an cross-sectional exploded perspective view of a portion of another exemplary embodiment of a nozzle constructed in accordance with the present invention, showing a third flow channel for providing a flow boost to half of the swirl ante-chambers.
Figure 23:
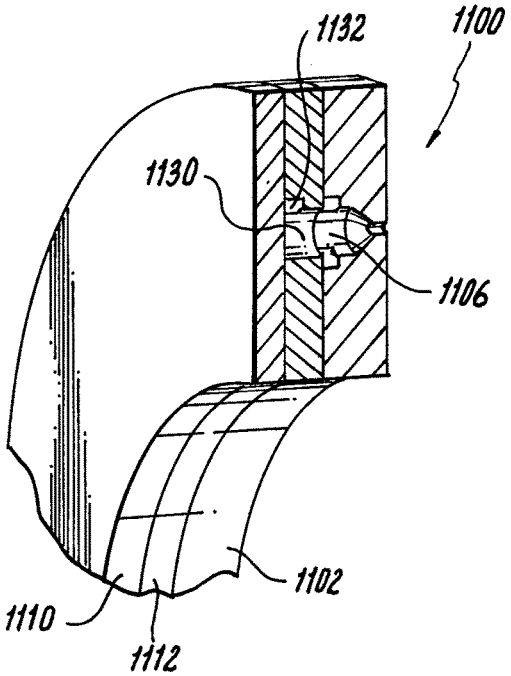
FIG. 23 is a cross-sectional perspective view of the nozzle of FIG. 22, showing the three stacked plates assembled together.

With reference to FIG. 22, in certain applications it may be beneficial to have two counter-swirling channels feeding into every point on an injector, plus an additional co-swirling channel which feeds every other injector. Injector 1100 includes a nozzle body 1102 as described above with respect to FIG. 15, backing member 1110, and intermediate member 1112. Intermediate member 1112 includes through chambers 1130 that when assembled as shown in FIG. 23 are aligned with every other swirl ante-chamber 1106. A third flow channel 1132 is defined in intermediate member 1112 for supplying boost flow to the one half of the swirl ante-chambers 1106 having through chambers 1130, which boost flow is in addition to the flow from the two flow channels defined in nozzle body 1102. FIGS. 22 and 23 are schematic in that the full flow circuitry, e.g., inlets, of backing and intermediate members 1110 and 1112 is not shown for sake of simplicity. This configuration allows control to boost the amount of fuel into half of the injectors, as when staging fuel, while still maintaining the ability to control the spray angles. This configuration also allows for a controllable-angle duplex atomizer as well as multi-fuel applications.

Figure 24:
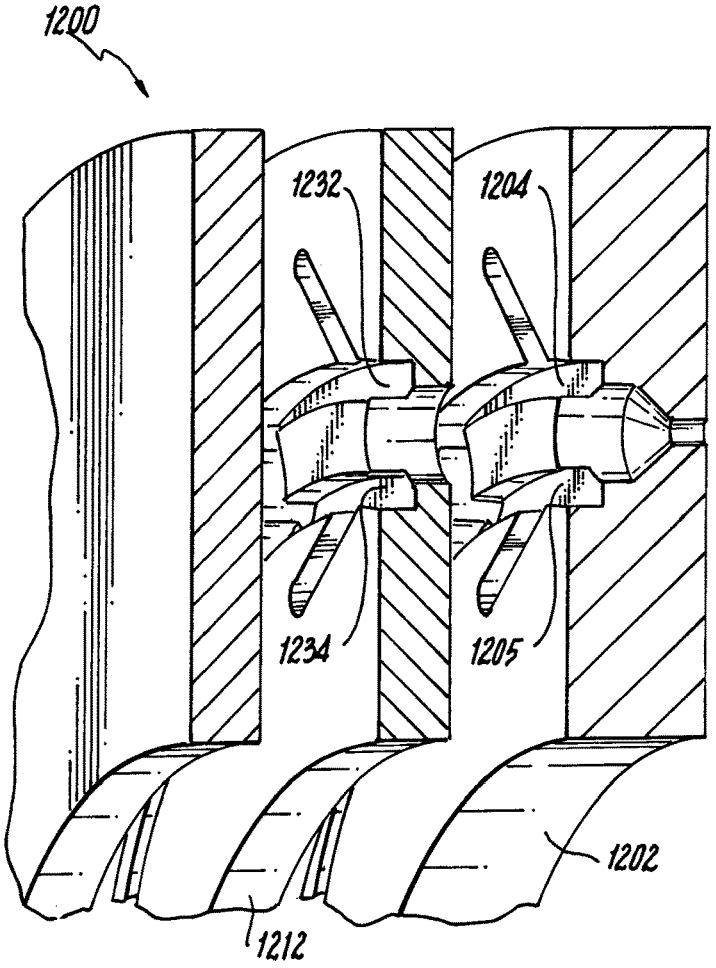
FIG. 24 is a cross-sectional exploded perspective view of a portion of another exemplary embodiment of a nozzle constructed in accordance with the present invention, showing a fourth flow channel for providing additional flow boost for flow staging.
Figure 25:
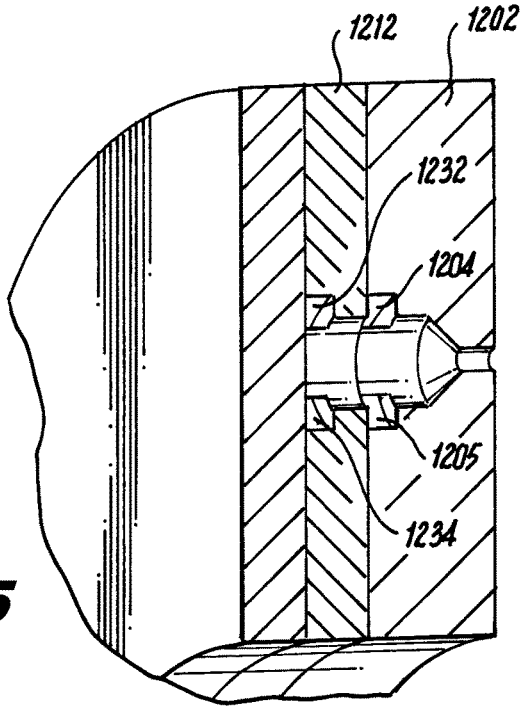
FIG. 25 is a cross-sectional perspective view of the nozzle of FIG. 24, showing the three stacked plates assembled together.

Referring to FIG. 24, another exemplary embodiment of an injector 1200 includes four flow channels where two flow channels 1204 and 1205 are defined in nozzle body 1202, and two flow channels 1232 and 1234 are defined in intermediate member 1212. This configuration allows for staging and/or multi-fuel capability, wherein flows in flow channels 1204 and 1205 can be boosted by flows from flow channels 1232 and 1234, respectively. FIGS. 24 and 25 can be compared to FIGS. 22 and 23 described above, and are similarly schematic for sake of clarity.

While shown and described above in the exemplary context of fuel injection for gas turbine engines, those skilled in the art will readily appreciate that any suitable fluids can be used and that any other suitable applications can make use of nozzles and injectors as described herein without departing from the spirit and scope of the invention. While described above in the exemplary context of multi-point injection, those skilled in the art will readily appreciate that any suitable number of injection points can be used, including single point injection, without departing from the spirit and scope of the invention.

The methods and systems of the present invention, as described above and shown in the drawings, provide for injection with superior properties including simplified geometry and fluidic control of spray angle. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A nozzle for injecting liquid comprising:

a nozzle body defining a first flow channel and a second flow channel and a plurality of swirl ante-chambers each in fluid communication with the first flow channel, each of the plurality of swirl ante-chambers being in fluid communication with the second flow channel, with an injection point orifice defined in each swirl ante-chamber, wherein the first and second flow channels feed into the swirl ante-chambers to impart a tangential flow component on fluids entering each swirl ante-chamber to generate swirl on a spray issuing from the injection point orifices, the first flow channel, the second flow channel, and the swirl ante-chambers being configured and adapted for adjustment of spray angle on sprays issuing from the injection point orifices by varying flow apportionment among the first and second flow channels.

2. A nozzle as recited in claim 1, wherein the swirl ante-chambers and injection point orifices are all aligned parallel to a common axis.

3. A nozzle as recited in claim 1, wherein each swirl ante-chamber is aligned to the respective injection point orifice, and wherein the injection point orifices diverge from one another relative to a common axis.

4. A nozzle as recited in claim 1, wherein each swirl ante-chamber is aligned to the respective injection point orifice, and wherein the injection point orifices are directed radially outward relative to a common axis.

5. A nozzle as recited in claim 1, wherein each of the first and second flow channels is circuitous and flows back on itself.

6. A nozzle as recited in claim 1, wherein each swirl ante-chamber feeds tangentially off the first flow channel and off the second flow channel, with the first and second flow channels each being circuitious.

7. A nozzle as recited in claim 1, wherein the first flow channel feeds off-center into each swirl ante-chamber to impart a tangential flow component on fluids entering each swirl ante-chamber, and wherein the second flow channel feeds off-center into each swirl ante-chamber opposite the first flow channel to impart a tangential flow component on fluids entering each swirl ante-chamber.

* * * * *